US005425483A

United States Patent [19]

Mertes

[11] Patent Number: 5,425,483

[45] Date of Patent: Jun. 20, 1995

[54] DISPENSING CAP FOR VESSEL

[76] Inventor: James S. Mertes, 407 E. Waverly, Arlington Heights, Ill. 60004

[21] Appl. No.: 169,438

[22] Filed: Dec. 17, 1993

[51] Int. Cl.[6] ..... B05D 47/00

[52] U.S. Cl. ..... 222/561; 222/212

[58] Field of Search ..... 222/559, 560, 561, 212

[56] References Cited

U.S. PATENT DOCUMENTS

| | | | |
|---|---|---|---|
| 1,131,004 | 7/1919 | Miner | 222/561 X |
| 1,566,946 | 12/1925 | Witwer | 222/561 X |
| 1,803,799 | 5/1931 | Gueritey . | |
| 1,993,364 | 3/1935 | Ellstrom | 222/561 X |
| 1,995,967 | 3/1935 | Demers | 222/561 |
| 2,070,096 | 2/1937 | Smith | 222/561 |
| 2,123,643 | 7/1938 | Wilson | 222/559 |
| 2,274,562 | 2/1942 | Palmer . | |
| 2,448,625 | 9/1948 | Ruther | 222/561 X |
| 2,717,725 | 9/1955 | Bennett | 222/561 X |
| 2,808,186 | 10/1957 | Kates . | |
| 2,971,680 | 2/1961 | Wilson et al. | 222/561 X |
| 3,332,586 | 7/1967 | Amburgey . | |
| 3,355,069 | 11/1967 | Miles . | |
| 3,409,189 | 11/1968 | McKeand, Jr. . | |
| 4,819,829 | 4/1989 | Rosten et al. | 222/561 X |
| 4,856,681 | 8/1989 | Murray | 222/561 X |
| 4,925,067 | 5/1990 | Zemlo et al. . | |
| 5,125,542 | 6/1992 | Blanc | 222/561 X |
| 5,310,081 | 5/1994 | McCabe | 222/561 X |

FOREIGN PATENT DOCUMENTS

| | | | |
|---|---|---|---|
| 1229911 | 9/1960 | France | 222/561 |
| 2022203 | 11/1971 | Germany | 222/561 |
| 348952 | 5/1931 | United Kingdom | 222/561 |

*Primary Examiner*—Andres Kashnikow
*Assistant Examiner*—Kenneth R. DeRosa
*Attorney, Agent, or Firm*—Welsh & Katz, Ltd.

[57] ABSTRACT

A dispensing cap for use with a vessel or container includes a base adapted for mounting on a threaded neck discharge end of the container. The cap includes a slide valve which is longitudinally movable within a guide channel between a position preventing discharge of a flowable product from the vessel and either of two dispensing positions enabling dispensing of product. The cap is configured to enable stable support of the vessel in an inverted position so that product is always ready for substantially immediate dispensing from the vessel. The vessel is preferable squeezable and, in an alternative embodiment, may have similar opposite ends with a dispensing cap mounted on each end.

17 Claims, 1 Drawing Sheet

DISPENSING CAP FOR VESSEL

BACKGROUND OF THE INVENTION

The present invention relates generally to dispensing caps for vessels or containers, and more particularly to a novel dispensing cap adapted for mounting on the neck-end of a vessel and having a slide valve enabling manual movement to either of two discharge positions for dispensing flowable product from the vessel. The dispensing cap also facilitates easy storage of the vessel in an inverted position so that product is always at the discharge end of the vessel.

It is a common practice in marketing many types of flowable products to utilize vessels or containers having dispensing caps which remain mounted on the discharge end of the vessel during use. Such dispensing caps generally have a discharge orifice which communicates with the discharge opening of the vessel, and a movable closure element which is manually movable between a closed position closing off the discharge orifice and a discharge or operating position enabling dispensing of product from the vessel. See, for example, U.S. Pat. Nos. 1,803,799, 2,274,562, 2,808,186, 3,332,586, 3,355,069, 3,409,189 and 4,925,067.

One of the primary objects of the present invention is to provide an improved novel dispensing cap which finds particular application with vessels or containers to facilitate discharge of flowable product therefrom, and wherein the dispensing cap includes a slide valve movable to either of two different discharge positions enabling dispensing of product from the vessel.

A more particular object of the present invention is to provide a novel dispensing cap adapted for mounting on a threaded neck discharge end of a container or vessel having flowable product therein, and wherein the dispensing cap is configured to facilitate normal storage of the container in a inverted position so that the flowable product is always disposed adjacent the dispensing cap for immediate discharge when a slide valve of the dispensing cap is moved to either of two dispensing positions.

SUMMARY OF THE INVENTION

In accordance with a preferred embodiment of the present invention, a dispensing cap or closure is provided having a base adapted for mounting on an externally threaded neck discharge end of a vessel or container. The base has an axial discharge passage which communicates with the discharge end of the vessel. The base supports a slide valve within an open channel formed transversely of the cap adjacent an outer end surface. The slide valve has a pair of spaced discharge orifices and is manually movable between a closed position preventing discharge of product from the vessel, and either of two different discharge positions enabling dispensing of product from the vessel.

In the preferred embodiment, the base and slide valve have mutually cooperable detent means to releasably retain the slide valve in its closed or discharge positions, and the slide valve has friction grips on its opposite ends to facilitate friction gripping and movement by a user's thumb. The outer end surface of the dispensing cap is configured to facilitate normal storage of the vessel in an inverted position so that product is adjacent the dispensing cap for immediate dispensing on moving the slide valve to a discharge position. The vessel preferably has a rounded end opposite its cap mounting neck-end, and is squeezable to facilitate dispensing of flowable product. In an alternative embodiment, the squeezable vessel has opposite externally threaded neck-ends with a dispensing cap in accordance with the present invention mounted on each end.

Further objects, advantages and features of the invention will become apparent from the following detailed description taken in conjunction with the accompanying drawing wherein like reference numerals designate like elements throughout the several views.

DETAILED DESCRIPTION

Figure 1:
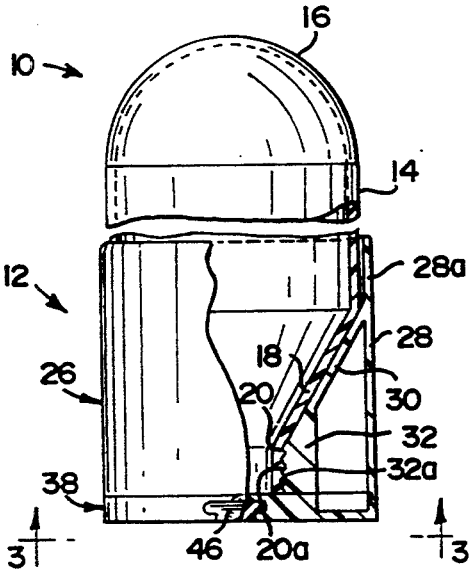
FIG. 1 is an elevational view of a vessel or container and dispensing cap in accordance with the present invention.
Figure 2:
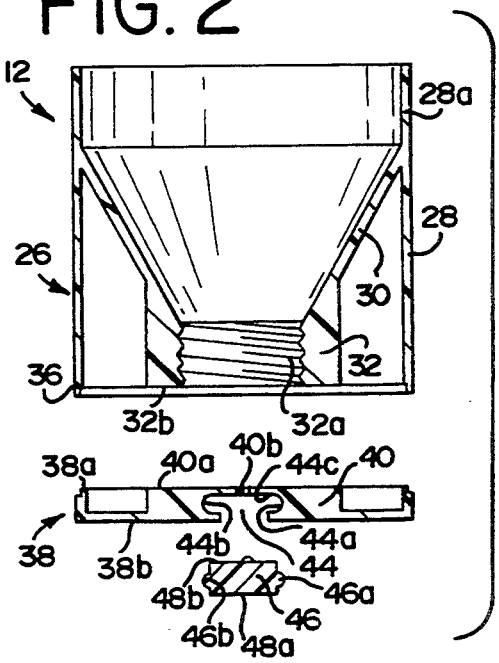
FIG. 2 is an exploded longitudinal sectional view of the dispensing cap of FIG. 1.

Referring now to the drawing, a vessel, alternatively termed a container, adapted to receive a flowable product therein is indicated generally at 10. A dispensing cap 12 constructed in accordance with the present invention is mounted on a discharge end of the vessel 10 and facilitates selective discharge of product from the vessel.

The vessel or container 10 is preferably made of a suitable plastic material which is transparent or translucent to enable visual observation of a flowable product, such as a condiment or the like, internally of the vessel. The vessel has a generally cylindrical body portion 14, a generally semi-spherical end 16 and an opposite generally frustoconical end 18 which terminates in an externally threaded neck portion 20 defining an internal axial discharge passage 20a. The vessel or container may be made as an integral unitary vessel, and is preferably of a hand-holdable size, such as any desired size up to a 16 ounce or 32 ounce container, although larger sizes may also be contemplated. The vessel is preferably semi-rigid in its longitudinal direction to support itself but has sufficient flexibility to enable the generally cylindrical body portion 14 to be squeezed inwardly to facilitate dispensing of product from within the vessel.

The dispensing cap 12 includes a base portion 26 which may be formed from a suitable rigid plastic material as a unitary base and includes an outer annular wall 28. An inner generally frustoconical wall 30 is integrally connected at its outer diameter to annular wall 28 and has a longitudinal axis coaxial with the axis of the outer cylindrical wall 28. The wall 30 has a conical taper substantially equal to the conical taper of the frustoconical end 18 of the vessel or container 10. An annular wall 32 is preferably formed integral with the frustoconical wall 30 and has an axial internal threaded bore 32*a* adapted for threaded connection with the external thread on the neck end 20 of the vessel 10. The annular wall 28 has an annular wall portion 28*a* which has an inner diameter slightly greater than the outer diameter of the cylindrical body portion 14 of the vessel so that the base 26 may be mounted on the threaded neck-end of the vessel with the frustoconical wall 30 engaging the frustoconical end 18 of the vessel and with the annular wall portion 28*a* partially overlying the cylindrical portion 14 of the vessel.

The annular wall 32 within the cap base 26 has a planar end surface 32*b* which lies in substantially coplanar relation with an outer annular end 20*b* of the neck end of the vessel when the cap base is threadedly mounted on the vessel neck end. The annular wall 28 of the cap base 26 has an annular stepped end edge surface 36 which is substantially coplanar with the end surface 32*b* and is adapted for mutual engagement with a complimentary stepped annular edge surface 38*a* formed on a generally circular slide valve holder 38. The slide valve holder 38 is also preferably made of a suitable plastic material and includes a generally cylindrical boss 40 having a planar surface 40*a* adapted to engage the end surface 32*b* of the cap base portion 26 when the annular edge 38*a* is fixed to the stepped annular end surface 36 on the cap base. The slide valve holder 38 has a generally circular planar surface 38*b* which lies parallel to the surface 40*a* and is disposed transverse to the longitudinal axis of the cap base 26 when the slide valve holder is fixed on the cap base.

A slide or guide channel 44 is formed in the slide valve holder 38 so as to lie on a diameter of the slide valve holder in symmetrical relation about a plane containing the longitudinal center axis of the guide channel and perpendicular to the end surface 38*a*. The laterally opposed longitudinal edges of the guide channel 44 are defined by generally radial concave edge surfaces 44*a* and 44*b* which define guide ways for mutual cooperation with correspondingly configured longitudinal guide elements 46*a* and 46*b* formed on the opposite edges of a slide valve 46 so as to enable longitudinal sliding movement of the slide valve within the guide channel. The slide valve 46 has parallel substantially planar outer surfaces 48*a* and 48*b*. The surface 48*b* slidably engages a planar base surface 44*c* of the guide channel 44 when the slide valve is inserted within the guide channel. The outer surface 48*a* of the slide valve 46 is then substantially coplanar with the planar end surface 38*b* on the slide valve holder 38.

Figure 4:
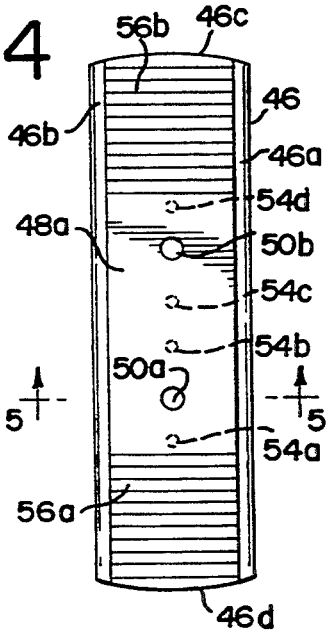
FIG. 4 is a plan view of the slide valve of the dispensing cap of FIG. 1.

In accordance with one feature of the dispensing cap 12 in accordance with the present invention, the slide valve holder 38 has a central flow orifice 40*b* formed axially within the cylindrical boss 40 so as to lie in coaxial relation with the discharge passage 20*a* in the vessel 10 when the dispensing cap is mounted thereof. Referring particularly to FIG. 4, the slide valve 46 preferably has a longitudinal length substantially equal to the longitudinal length of the guide channel 44 and has opposite arcuate end surfaces 46*c* and 46*d* having radial curvatures substantially equal to the radius of the outer annular wall 28 of the cap base 26. The slide valve 46 has a pair of longitudinally spaced discharge or dispensing orifices 50*a* and 50*b* formed therethrough which are spaced equal distances from the transverse center of the slide valve and adapted to be individually positioned in axial alignment with the discharge opening 40*b* in the slide valve holder 38. The slide valve 46 is thus longitudinally movable between a centered position blocking discharge from the orifice 40*b* and either of two operating or dispensing positions wherein one or the other of the dispensing orifices 50*a* and 50*b* is positioned in overlying axial alignment with the discharge orifice 40*b*. The discharge orifice 40*b* and dispensing orifices 50*a* and 50*b* are preferably circular in transverse cross section and are sized to facilitate dispensing of various viscosity flowable products or materials as may be stored within the vessel.

Figure 3:
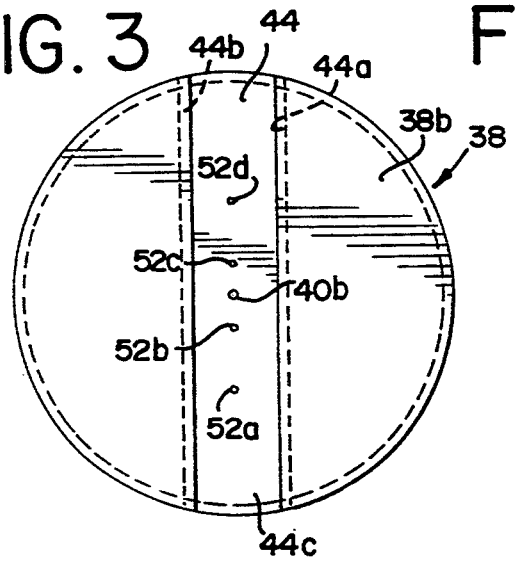
FIG. 3 is a plan view, on an enlarged scale, of the dispensing cap of FIG. 1, taken along line 3—3 of FIG. 1 but with the slide valve member removed.

To maintain the slide valve 46 in either its centered non-dispensing position, or in either one of its two discharge positions, the slide valve and slide valve holder 38 have mutually cooperable detent means operative to frictionally retain the slide valve in the position to which it has been manually moved. In the illustrated embodiment, the slide valve holder 38 has a plurality of longitudinally spaced concave recesses or cavities formed in a lower planar surface 44*c*, as indicated at 52*a–d* in FIG. 3. The slide valve 46 has a plurality of similarly positioned male or convex detent projections 54*a–d* formed along its lower surface 48*b* for cooperating relation with the concave recesses 52*a–d* to maintain the slide valve in either its neutral non-discharge position or either of its two dispensing positions.

With the dispensing cap 12 mounted on the vessel 10 through threaded engagement of the internal thread 32*a* with the external thread on the neck end 20 of the vessel, it will be appreciated that when the slide valve 46 is in its centered position within the guide channel 44, dispensing of product from the dispensing cap is prevented. Longitudinal movement of the slide valve 46 to either of its dispensing positions aligning either one of the dispensing orifices 50*a* or 50*b* with the discharge orifice 40*b* in the slide valve holder 38 enables dispensing of flowable product from the vessel. To facilitate movement of the slide valve 46 by engagement with the user's thumb or a finger, a plurality of generally transverse ribs or serrations are provided on the outer exposed surface 48*a* of the slide valve adjacent each of its opposite ends, such as indicated at 56*a* and 56*b* in FIG. 4.

In accordance with another feature of the dispensing cap 12, the outer diameter of planar end surface 38*b* of the dispensing cap is substantially equal to the outer diameter of the cylindrical portion 14 of the vessel 10 so as to facilitate stable normal storage of the vessel in an inverted position, such as on a cabinet shelf or in a refrigerator. In this position, the flowable product within the vessel is always disposed within the discharge passage 20*a* of the vessel and thus ready for substantially immediate discharge upon moving the slide valve 46 to either of its dispensing positions.

Figure 6:
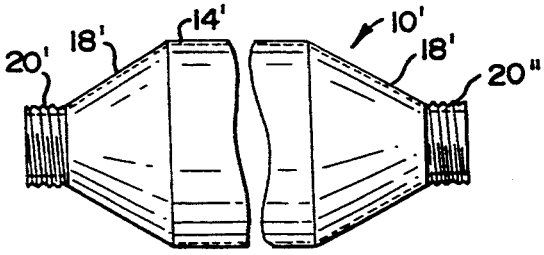
FIG. 6 is a foreshortened elevational view of an alternative vessel or container having similar threaded-neck opposite discharge ends enabling mounting of a dispensing cap on each end thereof.
Figure 5:
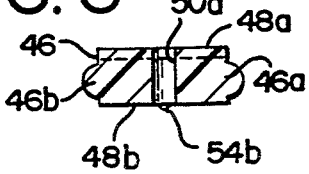
FIG. 5 is a transverse sectional view taken substantially along line 5—5 of FIG. 4.

FIG. 6 illustrates an alternative embodiment of a vessel, indicated generally at 10', in accordance with the present invention. The vessel or container 10' is also preferably made of a suitable transparent or translucent plastic and has a squeezable cylindrical body portion 14' and a pair of opposite externally threaded neck ends 20' and 20'', each of which has an internal discharge passage therethrough, such as indicated at 20'*a* and 20''*a*. The opposite threaded neck ends 20' and 20'' of the vessel 10' are adapted to have dispensing caps mounted thereon such as the aforedescribed dispensing cap 12. In this manner, the vessel 10' can be stored in a vertical orientation on either of its opposite ends through engagement of the external planar end surface of the corresponding dispensing cap, with product thus being disposed adjacent the dispensing cap on which the vessel rests to facilitate substantially immediate dispensing of a flowable product from the vessel upon movement of the corresponding slide valve to either of its dispensing positions.

Thus, it will be appreciated that in accordance with the present invention a novel dispensing cap is provided which, in combination with a squeezable vessel or container on which the dispensing cap is mounted, facilitates storage of the vessel in a generally vertical inverted orientation resting on the associated dispensing cap so that product within the vessel flows by gravity to the dispensing cap end of the vessel and facilitates substantially immediate dispensing when the dispensing cap slide valve is moved to either of its dispensing positions with the vessel inverted.

While a preferred embodiment of a dispensing cap and associated vessel or container in accordance with the present invention has been illustrated and described, it will be understood that changes and modifications may be made therein without departing from the invention in its broader aspects. Various features of the invention are defined in the following claims.

What is claimed is:

1. A dispensing cap for use on a vessel of the type adapted to contain a flowable product and having a frustoconical discharge end terminating in a discharge opening defined by a generally tubular neck having an external thread thereon, said dispensing cap having a cylindrical outer wall of a diameter substantially equal to the diameter of the larger end of said frustoconical discharge end and having a frustoconical inner wall, said cap having an axial discharge orifice adapted for mounting on said threaded tubular neck with said inner frustoconical wall engaging said frustoconical discharge end of said vessel, said cap having a generally planar end surface disposed substantially transverse to the longitudinal axis of the vessel when the cap is mounted on the neck, said cap having a diametral channel formed therein opening outwardly of said end surface and extending the full diameter of said cap in communication with said discharge orifice, and a slide valve slidable within said channel and having at least two dispensing orifices therethrough spaced along the length of said slide valve, said slide valve being longitudinally movable between a first position blocking discharge from the discharge orifice in the car and either of two dispensing positions placing a selected one of said dispensing orifices in alignment with said discharge orifice.

2. A dispensing cap as defined in claim 1 wherein said slide valve and said cap having mutually cooperable means operative to releasably retain said slide valve in said first position and in either of said dispensing positions.

3. A dispensing cap as defined in claim 2 wherein said mutually cooperable means comprises at least one convex detent formed on a selected one of said cap and slide valve, and at least one concave recess formed on the other of said cap or slide valve.

4. A dispensing cap as defined in claim 2 wherein said cap has a plurality of concave recesses formed therein within said guide channel, said slide valve having a plurality of convex detents formed thereon for releasable registry with said recesses to facilitate selective positioning of said slide valve within said guide channel.

5. A dispensing cap as defined in claim 1 wherein said planar end surface of said cap is sized to facilitate stable storage of the vessel with its discharge opening directed downwardly when said cap is mounted thereon.

6. A dispensing cap as defined in claim 1 wherein said guide channel has laterally opposed longitudinal guide ways therein, said slide valve having outwardly extending longitudinal guide elements received within said guide ways.

7. A dispensing cap as defined in claim 1 wherein said slide valve has friction grip means thereon for facilitating manual movement of said slide valve.

8. A dispensing cap as defined in claim 7 wherein said friction grip means comprising a plurality of transverse ridges formed on said exposed surface of said slide valve.

9. A dispensing cap as defined in claim 8 including a plurality of said ridges formed on opposite ends of the slide valve.

10. A hand-holdable vessel for containing a flowable product and having a dispensing cap enabling discharge of product from the vessel, said vessel having a generally cylindrical outer peripheral wall terminating at one end in a substantially frustoconical wall having a generally tubular neck thereon defining a discharge opening, said dispensing cap having an outer annular wall of substantially similar diameter to the cylindrical peripheral wall of the vessel and having an inner generally frustoconical wall integrally connected to its outer annular wall, said cap being mounted on the tubular neck so that said inner frustoconical wall engages the frustoconical wall on said vessel, said cap having a generally planar end surface disposed substantially transverse to a longitudinal axis of the vessel to facilitate upstanding support of said vessel with its discharge opening facing downwardly by engagement of said end surface with a generally horizontal support surface, said cap having a discharge orifice communicating with said discharge opening, and having a diametral channel formed therein opening outwardly of said planar end surface and intersecting said discharge orifice, and a slide valve carried by the cap within said channel and having an outer exposed planar surface substantially coplanar with said planar end surface, said slide valve having at least two dispensing orifices therethrough spaced along the length of said slide valve and being longitudinally movable between a first centered position within said channel blocking discharge from said discharge orifice and second positions wherein the slide valve is moved to either of two dispensing positions placing one or the other of said dispensing orifices in alignment with said discharge orifice to enable dispensing of flowable product from the vessel.

11. A vessel as defined in claim 10 wherein said tubular neck has an external thread thereon, said discharqe orifice of said cap being defined by an internally threaded passage having threaded connection with said neck.

12. A vessel as defined in claim 10 wherein said generally cylindrical outer peripheral wall of said vessel is squeezable to facilitate dispensing of product from the dispensing cap.

13. A vessel as defined in claim 12 wherein the vessel has a generally semi-spherical end opposite said frustoconical end.

14. A vessel as defined in claim 13 wherein the vessel has similar frustoconical opposite ends each of which has a tubular neck adapted to receive one of said dispensing caps in mounted relation thereon.

15. A dispensing cap as defined in claim 10 wherein said guide channel has laterally opposed longitudinal guide ways therein, said slide valve having outwardly extending longitudinal guide elements received within said guide ways.

16. A dispensing cap as defined in claim 15 wherein said slide valve and said guide channel have mutually cooperable means for releasably retaining said slide valve in said first position or in either of said dispensing positions.

17. A hand-holdable vessel for containing a flowable product and having a dispensing cap enabling discharge of product from the vessel, said vessel having a generally cylindrical squeezable outer peripheral wall terminating at one end in a substantially frustoconical wall having a generally tubular neck thereon defining a discharge opening coaxial with a longitudinal axis of said cylindrical wall, said dispensing cap having an outer annular wall of substantially similar diameter to said outer peripheral vessel wall and having an inner frustoconical wall integrally connected to said annular wall, said cap being mounted on said tubular neck with said inner frustoconical wall engaging said frustoconical vessel wall and having a generally planar end surface disposed substantially transverse to a longitudinal axis of the vessel to enable upstanding support of said vessel by engagement of said planar end surface with a generally horizontal support surface, said cap having a discharge orifice communicating with said discharge opening and having a diametral channel formed therein opening outwardly of said planar end surface and intersecting said discharge orifice, said channel extending the full diameter of said cap and being defined by laterally opposite concave guideways, and a slide valve carried by the cap within said channel and having an outer exposed planar surface substantially coplanar with said planar end surface, said slide valve having longitudinal guide elements slidable within said guideways and having arcuate ends substantially coplanar with the outer cylindrical wall of the vessel when the valve is centered within said channel, said slide valve being adapted to close said discharge orifice when in said centered position and having at least two dispensing orifices therethrough spaced along the length of said slide valve and enabling discharge from said discharge orifice when moved to either of at least two dispensing positions placing one of said dispensing orifices in alignment with said discharge orifice to enable dispensing of flowable product from the vessel.

* * * * *

UNITED STATES PATENT AND TRADEMARK OFFICE

CERTIFICATE OF CORRECTION

PATENT NO. : 5,425,483

DATED : June 20, 1995

INVENTOR(S) : James S. Mertes

It is certified that error appears in the above-indentified patent and that said Letters Patent is hereby corrected as shown below:

Column 5, line 44, "car" should read --cap--.

Column 6, line 51, "discharqe" should read --discharge--.

Signed and Sealed this

Twelfth Day of September, 1995

*Attest:*

Bruce Lehman

BRUCE LEHMAN

*Attesting Officer*

*Commissioner of Patents and Trademarks*